US005165580A

United States Patent [19]

Rosenthal

[11] Patent Number: 5,165,580

[45] Date of Patent: Nov. 24, 1992

[54] OPTICAL ILLUSION WATER DISPLAY DEVICE

[76] Inventor: L. Kenneth Rosenthal, 10306 Rossbury Pl., Los Angeles, Calif. 90064

[21] Appl. No.: 789,798

[22] Filed: Nov. 12, 1991

Related U.S. Application Data

[63] Continuation-in-part of Ser. No. 546,923, Jul. 2, 1990, abandoned.

[51] Int. Cl.[5] ..... B67D 1/00; G09F 19/00

[52] U.S. Cl. ..... 222/251; 40/439; 40/442; 362/96; 446/475; 239/102.1

[58] Field of Search ..... 222/129.1, 333, 420, 222/422, 383, 644, 109, 78, 251; 446/475, 485, 219, 175; 40/406, 407, 409, 439, 441, 442; 362/811, 806, 96; 239/18, 20, 23, 102.1, 102.2; 141/69, 70, 94, 98, 392

[56] References Cited

U.S. PATENT DOCUMENTS

| | | | |
|---|---|---|---|
| 4,265,402 | 5/1981 | Tsai | 272/8 P X |
| 4,294,406 | 10/1981 | Pevnick | 239/20 |
| 4,426,021 | 1/1984 | Rosenthal | 222/129.1 |

*Primary Examiner*—Andres Kashnikow
*Assistant Examiner*—Kenneth DeRosa
*Attorney, Agent, or Firm*—L. Kenneth Rosenthal

[57] ABSTRACT

The invention relates to creating an optical illusion of fluid or water in a display device which shows a solid water stream with undulations that rises, levitates or falls slowly. The illusion can be viewed under certain circumstances in ordinary room lighting. Also, the solid water stream with undulations can simultaneously transform into a set of rising, levitating or falling water droplets. The entire illusion may be examined and even touched by the audience.

9 Claims, 3 Drawing Sheets

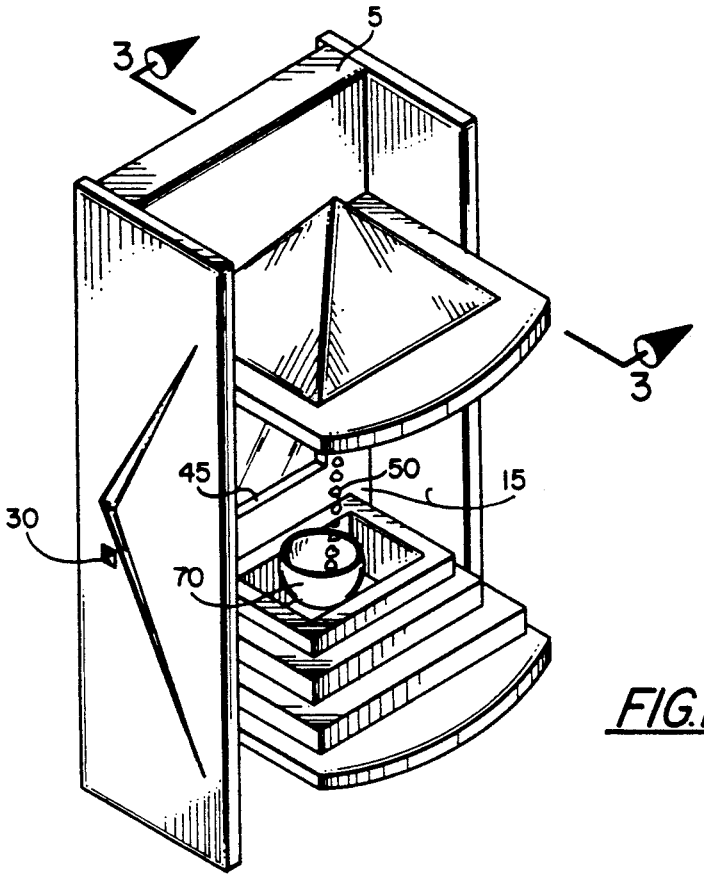
FIG.1
FIG.2
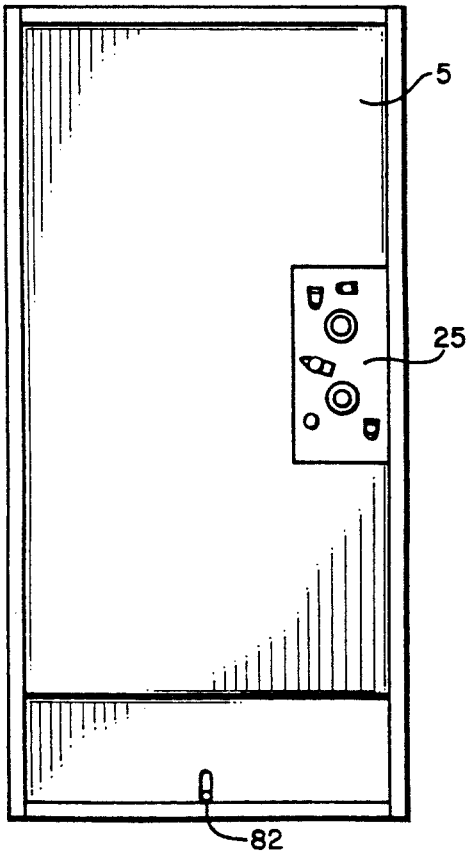

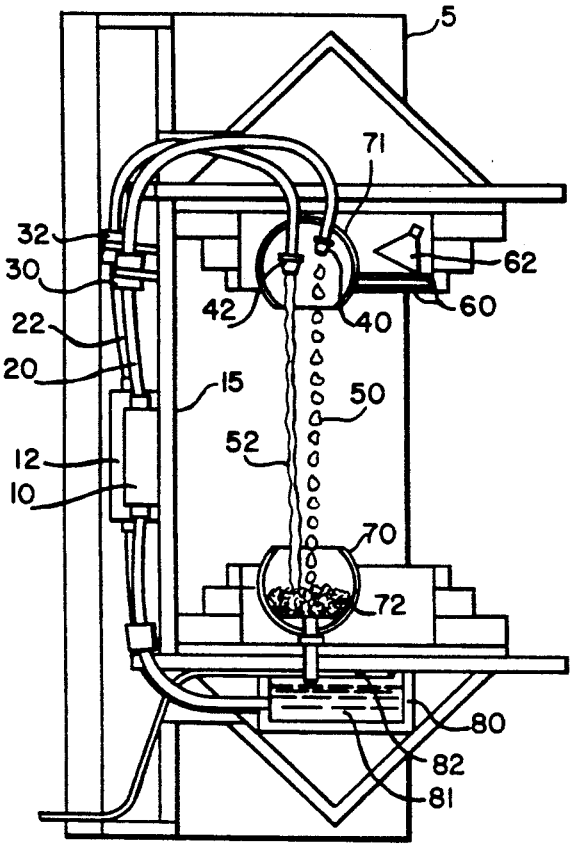
FIG. 3
FIG. 4
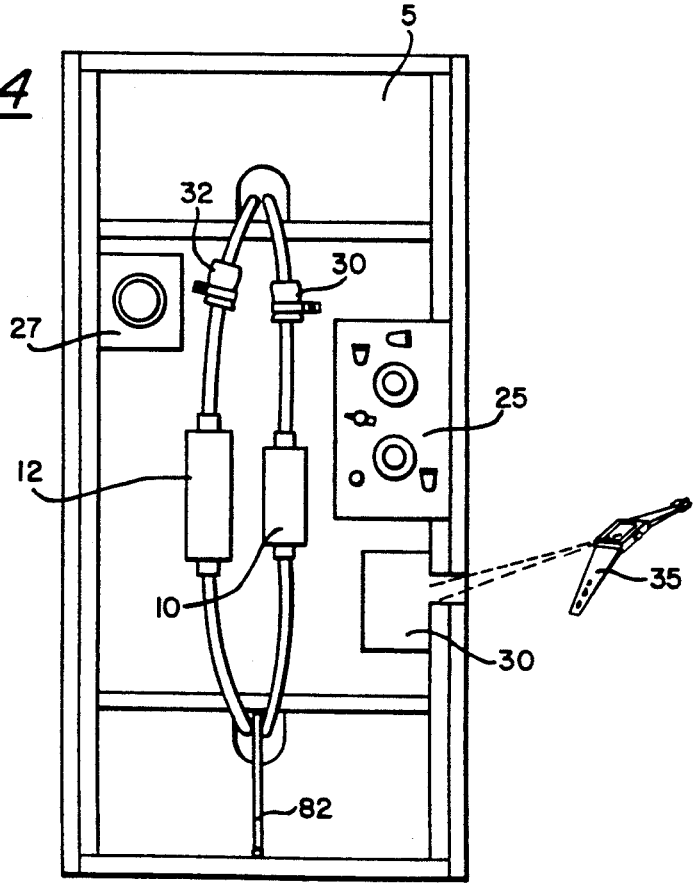

OPTICAL ILLUSION WATER DISPLAY DEVICE

This is a continuation-in-part of Ser. No. 07/546,923 filed on Jul. 2, 1990, now abandoned.

BACKGROUND OF THE INVENTION

1. Field of the Invention

The invention relates to a fluid display device which creates the illusion of a solid fluid stream with undulations and/or fluid droplets of rising, levitating or falling slowly.

2. Description of the Prior Art

U.S. Pat. No. 4,426,021 discloses an optical illusion beverage dispensing device which creates the illusion of liquid droplets which appear to rise despite the act of filling a drinking glass. This illusion under certain conditions can be operated in room lighting provided that an enclosure and optical surface are properly designed to mask the ambient light of the room.

in a paper entitled *Unique Optical Illusions from a Magician's Perspective* published in the SOCIETY OF PHOTO-OPTICAL AND INSTRUMENTATION ENGINEERS PROCEEDINGS, Volume 391, Jan. 20 through 21, 1983 on pp. 91 through 102 various methods employed by magicians of levitating, defying gravity, and performing other illusions primarily with human beings and other solid props are discussed.

Various scientific museums have displays of engineering and scientific principles relating to gravity and strobe lights. The more notable are found at the Exploratorium in San Francisco, the Chicago Museum of Science and Industry, the Deutches Museum in Munich, the Evoluon in Einhoven, Holland, the Science Museum in Barcelona, and the Museums of Holography in New York and Stockholm.

Also, various family entertainment parks have displays of illusions of various sorts relying on certain scientific principles. U.S. Pat. No. 4,426,021, for example, can be seen in the Magic Shop in Tokyo Disneyland. The Ripley's Believe It or Not Exhibits and the Guiness Museum Exhibits which can be seen in various cities throughout the United States and abroad also contain various illusions relating to levitation and antigravity. The Ancol in Jakarta, the World Expo in Vancouver in 1986, EPCOT in Florida, and Tivoli in Stockholm also have various illusions which rely on holographic, optical, special effects, classical magic, or human perception principles.

None of the establishments mentioned above have displays or exhibits relating to the illusion of a solid fluid or water stream which rises, levitates or slowly falls. A popular exhibit at various amusement parks listed above and also available for purchase at various toy and gift shops involves a faucet which appears to float on a solid stream of water. This illusion, however, only relates to a falling stream of water, and on disassemblement of the illusion a clear plastic pipe is seen supporting the faucet or other spigot device. No illusion has ever been created which allows a viewer to see a slowly rising solid fluid or solid water stream with undulations which can also levitate or fall slowly, and which can be fully examined including physically touching the water stream.

SUMMARY OF THE INVENTION

This invention relates to an optical illusion fluid or water display device which creates the illusion of a solid fluid or water stream with undulations rising, falling slowly, and levitating in full and close-up view of an audience. The solid water stream with undulations can be examined and touched. The illusion of the solid water stream with undulations, rising, falling slowly, and levitating can be viewed in certain circumstances in room lighting.

A further object of the invention is to instantly create from the rising, solid water stream with undulations a set of rising, falling and levitating water droplets.

A further object of the invention is to provide a strobe light which is operated at or above the flicker fusion frequency to insure that the audience views the illusion with the perception of constant and ordinary ambient light.

A further object of the invention is to utilize two pieces of multi-layered dielectric glass positioned in front of the strobe light which act to maximize the transmission of the strobe light and minimize the noise of the strobe light.

A further object of the invention is to turn the illusion on and off with a remote control device.

Further objects of the invention will become apparent from the study of the following portions of the specification, the claims, and the attached drawings.

BRIEF DESCRIPTION OF THE DRAWINGS

FIG. 1 is a perspective view of the optical illusion fluid display device.

FIG. 2 is a back view of the optical illusion fluid display device.

FIG. 3 is a sectional view taken along line 3—3 in FIG. 1.

FIG. 4 depicts the back inside view of the optical illusion display device with the cover removed.

DETAILED DESCRIPTIONS OF THE DRAWINGS

Figure 5:
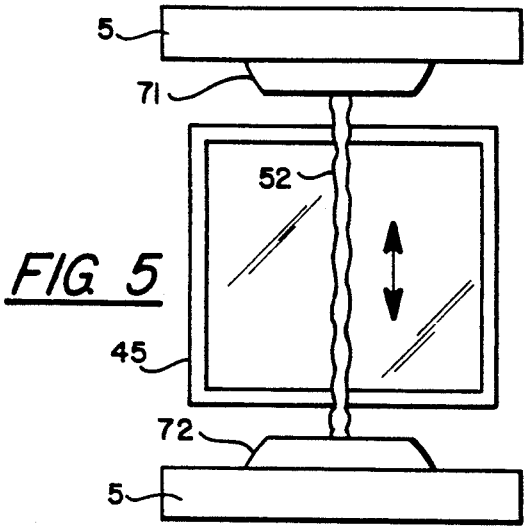
FIG. 5 shows a front view of the solid fluid stream with undulations.

In FIG. 1 the optical illusion fluid display device is portrayed in a perspective drawing. It should be noted that when referring to water, the more general term "fluid" could be used interchangeably, and the optical illusion display device can be operated equally well with water as well as any number of fluids of various viscosities and densities.

Water droplets 50 in FIG. 1 are seen to rise, fall and levitate. Enclosure 5 provides a housing for blocking ambient room light from directly striking the water droplets 50.

In FIG. 3, water 81 is held in reservoir 80. Drain 82 prevents overfilling of water 81 without having to remove bottom spherical container 70 for inspection. First oscillating pump 10 receives water 81 and provides pulsations. The pulsated water from first oscillating pump 10 then proceeds via first tube 20 to first nozzle 40 which causes the pulsating water to breakup into water droplets 50. Water droplets 50 proceed down to bottom spherical container 70 where they are met by antisplash material 72.

In a similar fashion second oscillating pump 12 provides pulsations to water 81 which are transmitted in second tube 22 to second nozzle 42. The second nozzle 42 is typically wider than first nozzle 40 and therefore the pulsating water forms undulations on its departure from second nozzle 42 and proceeds down with the appearance of a solid water stream with undulations 52 from top spherical container 71 to bottom spherical container 70 into antisplash material 72. Both first nozzle 40 and second nozzle 42 can be shaped in a conical form.

Strobe light 62 which operates at or above the flicker fusion frequency shines through one, two or three pieces of multi-layered dielectric glass 60 which maximize the transmission of the strobe light 62 while minimizing the noise of strobe light 62. The strobe light 62 then passes through water droplets 50 and solid water stream with undulations 52 and impinges on optical surface 15 which reflects and defuses the strobe light 62 back through water droplets 50 and/or solid water stream with undulation 52 creating the illusion of rising, falling, or levitating water droplets 52 or solid water stream with undulations 52 depending on the frequency of the strobe light 62.

In a preferred embodiment strobe light 62 operates between 55 and 65 hertz with an illumination to insure that the audience perceives the illusion with the appearance of ambient light. In this preferred embodiment both first oscillating pump 10 and second oscillating pump 12 operate at 60 hertz.

In FIG. 3 antivibration holder 30 insures that first tube 20 will not vibrate too extensively to degrade the illusion, and second antivibration holder 32 insures that second tube 22 likewise will not vibrate too harshly to degrade the illusion.

Enclosure 5 again insures that ambient light will not directly strike on water droplets 50 and solid water stream with undulations 52. Optical surface 15 which may be any surface which reflects and diffuses the strobe light 62 and insures a maximal viewing effect. The illusion, incidentally, under certain conditions could be viewed without optical surface 15 and enclosure 5 if ambient light were very dim or had an intensity which was small compared to strobe light 62.

In FIG. 4 electronic box 25 controls the intensity of pulsation on first oscillating pump 10 and second oscillating pump 12. Electronic box 25 also may contain a two or three-way electronic switch which allows first oscillating pump 10 and second oscillating pump 12 to be on together or separately. In one embodiment a three-way electronic switch in electronic box 25 could simultaneously turn off the first oscillating pump 10 while turning on second oscillating pump 12 creating the illusion of water droplets 50 simultaneously turning into solid water stream with undulations 52. This simultaneous transition is depicted in FIG. 7 where the water droplets 50 are shown going up, down or levitating depending on the frequency of the strobe light 62 and then in FIG. 6 when the environmentally drawn hand 69 in broken lines is waved in front of the illusion which upon application of a three-way electronic switch in electronic box 25 instantly to the audience changes into a solid water stream with undulations 52 that can be further seen in FIG. 5 with the environmentally drawn hand 69 removed. Of course, it is obvious to one skilled in the art that the illusion can be done in reverse, i.e. from a solid water stream with undulations 52 to the rising or falling water droplets 50. Also, it is obvious to one skilled in the art to have several pumps and nozzles in various combinations to show solid water streams with undulations and droplets of water together and simultaneously change from one state to the other.

The remote control device 35 (which is shown to be a watch in FIG. 4) activates the remote control electronic unit 30 which is connected to the electronic box 25. Also in FIG. 4 strobe light electronic box 27 houses the circuitry for strobe light 62.

Figure 6:
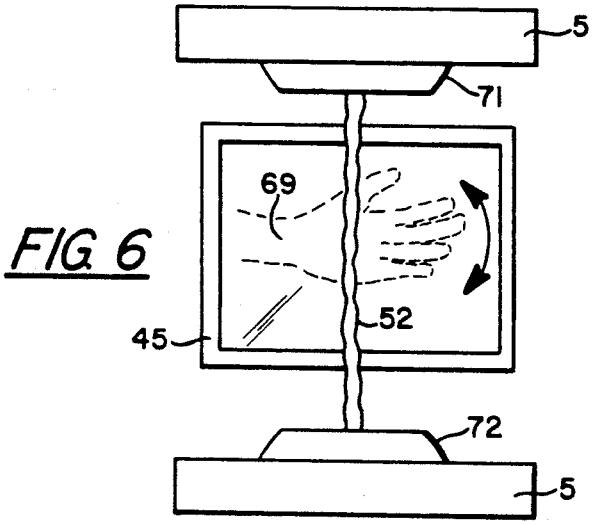
FIG. 6 shows the solid fluid stream with undulations with an environmental hand of a user shown in broken lines.
Figure 7:
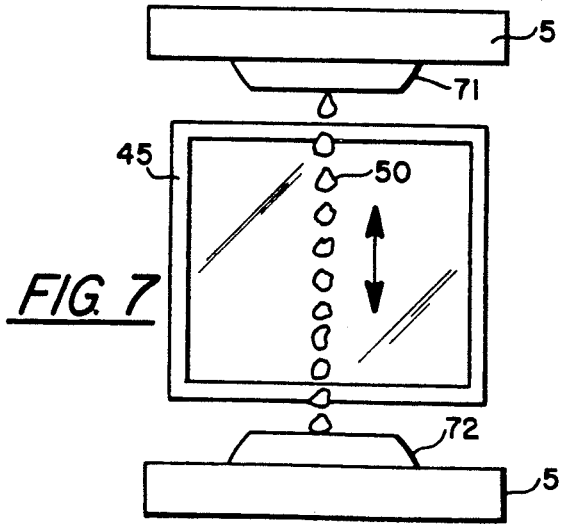
FIG. 7 shows the optical fluid display device portraying the rising and falling fluid droplets.

In FIGS. 5, 6 and 7 top spherical container 71 is shown, connected to enclosure 5, and bottom spherical container 72 is shown connected to another part of enclosure 5.

In FIG. 2 a back view of the illusion is depicted showing the enclosure with the electronic box 25 and the drain 82.

In FIG. 1 frame 45 provides a frame of reference for the audience regarding the illusion. Also in FIG. 1 remote control access hole 30 provides entry of the remote control signal from remote control device 35 into electronic box 25.

EXAMPLE

First oscillating pump 10 and second oscillating pump 12 may be 60 Hertz, self priming devices such as described in U.S. Pat. No. 3136257, and powered by 120 volt a.c. (line voltage) which is delivered through electronic box 25 which contains variable transformers to modify the applied voltage to the devices. First nozzle 20 may have an intake diameter of one-half inch and outtake diameter of one-quarter of an inch. Second nozzle 40 may have an intake diameter of one-half inch and an outtake diameter of three-eighth of an inch. When the varible transformers are adjusted to supply between 40 to 80 percent of line voltage to the first oscillating pump 10 then water droplets 50 flow from first nozzle 20. When the varible transformers are adjusted to provide between 50 to 90 percent of line voltage to the second oscillating pump 12 then solid water stream with undulations 52 will flow from second nozzle 42. A variety of stroboscopes, such as the General Radio (R) model 1542, may be employed provided that the strobe light 62 or other flashing light sources is seen to be above the flicker fusion frequency.

The above example may be modified with a variety of pump and nozzle configurations. A single oscillating pump can be used with two fixed diameter nozzles and a water value to produce water droplets 50 and solid water stream with undulations 52 as described in the above example. In a similar manner, a single oscillating pump and a single nozzle with a variable outtake diameter nozzle can produce both the water droplets 50 and solid stream with undulations 52.

The invention having been described in its preferred embodiments, it is clear that it is susceptible to numerous modifications and embodiments within the ability of those skilled in the art and without exercising of the inventive facility. Accordingly, the scope of the invention is defined by the scope of the claims.

I claim:

1. An optical illusion water display device comprising:

pump means for providing pulsation to the water;

nozzle means for producing a solid stream with undulations;

strobe light means which operate at or above the flicker-fusion frequency and illuminate said solid stream with undulations to create an illusion of said solid stream with undulations of rising, falling, and levitating.

2. The optical illusion water display device of claim 1 wherein an enclosure means is provided for holding said pump means, said nozzle means, and said strobe light means, and blocking ambient light from striking directly said solid stream with undulations.

3. The optical illusion water display device of claim 1 wherein said enclosure means house optical surface means which reflect and diffuse said strobe light means onto said solid water stream with undulations.

4. An optical illusion fluid display device comprising:

pump means for providing pulsation to the fluid;

nozzle means which produce a solid stream with undulations and fluid droplets; and strobe light means for operating at or above the flicker-fusion frequency and illuminating said solid stream with undulations and said fluid droplets to create the illusion of said fluid droplets and said solid stream with undulations of rising, falling, and levitating.

5. The optical illusion fluid display device of claim 4 wherein enclosure means and optical surface means are provided for blocking and masking ambient light.

6. An optical illusion water display device comprising:

first pump means for providing pulsation to water;

second pump means for providing pulsation to said water;

first nozzle means connected to said first pump means which produce water droplets;

second nozzle means connected to said second pump means which produce solid water stream with undulations;

strobe light means for operating at or above the flicker fusion frequency and illuminating said water droplets and said solid stream with undulations to create the illusion of said water droplets and said solid water stream with undulations of rising, falling, and levitating.

7. The optical illusion water display device of claim 6 wherein enclosure means is provided for holding said first pump means, said second pump means, said first nozzle means, said second nozzle means, and said strobe light means, and for blocking ambient light from directly striking on said water droplets and said solid stream with undulations.

8. The optical illusion water display device of claim 7 wherein said enclosure means house optical surface means which reflect and diffuse said strobe light means onto said water droplets and said solid water stream with undulations and mask said ambient light.

9. The optical illusion water display device of claim 6 wherein electronic means simultaneously switch on said first first pump means which produce said water droplets and switch off second pump means which produce said solid stream with undulations.

* * * * *